US012636537B2

(12) United States Patent
Domino

(10) Patent No.: US 12,636,537 B2
(45) Date of Patent: May 26, 2026

(54) BICEP CURL DEVICE

(71) Applicant: Donald Domino, Cypress, TX (US)

(72) Inventor: Donald Domino, Cypress, TX (US)

( * ) Notice: Subject to any disclaimer, the term of this patent is extended or adjusted under 35 U.S.C. 154(b) by 52 days.

(21) Appl. No.: 18/732,730

(22) Filed: Jun. 4, 2024

(65) Prior Publication Data

US 2025/0032838 A1 Jan. 30, 2025

Related U.S. Application Data

(60) Provisional application No. 63/529,170, filed on Jul. 27, 2023.

(51) Int. Cl.

| | |
|---|---|
| ***A63B 21/06*** | (2006.01) |
| ***A63B 21/00*** | (2006.01) |
| ***A63B 21/072*** | (2006.01) |
| ***A63B 23/12*** | (2006.01) |

(52) U.S. Cl.

CPC ..... *A63B 21/0608* (2013.01); *A63B 21/0724* (2013.01); *A63B 21/4035* (2015.10); *A63B 21/4049* (2015.10); *A63B 23/1281* (2013.01)

(58) Field of Classification Search

CPC ..... A63B 21/0608; A63B 21/0724; A63B 21/4035; A63B 21/4049; A63B 23/1281; A63B 21/0726; A63B 21/072

See application file for complete search history.

(56) References Cited

U.S. PATENT DOCUMENTS

| | | | | |
|---|---|---|---|---|
| 2,676,802 A * | 4/1954 | O'Brien | A63B 21/0724 | 482/106 |
| 4,103,887 A * | 8/1978 | Shoofler | A63B 21/0602 | 482/106 |
| 4,369,968 A * | 1/1983 | Price | A63B 21/0724 | 482/106 |
| 4,513,963 A * | 4/1985 | Nelson | A63B 21/00069 | 482/110 |
| 4,880,229 A * | 11/1989 | Broussard | A63B 21/0724 | 482/106 |
| 4,903,962 A * | 2/1990 | Pollack | A63B 21/0724 | 482/106 |
| 5,344,375 A * | 9/1994 | Cooper | A63B 21/0728 | 482/106 |
| 5,842,957 A * | 12/1998 | Wheeler | A63B 21/0602 | 482/106 |
| 6,022,300 A * | 2/2000 | Hightower | A63B 21/0728 | 482/106 |
| 6,436,015 B1 * | 8/2002 | Frasco | A63B 21/072 | 482/106 |

(Continued)

FOREIGN PATENT DOCUMENTS

WO WO-2016057055 A1 * 4/2016 ..... A63B 23/1281

*Primary Examiner* — Andrew S Lo
(74) *Attorney, Agent, or Firm* — Brennan, Manna Diamond, LLC

(57) ABSTRACT

A bicep curl device is provided. In one embodiment, the device is comprised of a bar with ends that can receive and/or may be comprised of a weight. The weight may have ball bearings that allow rotation of the weight to indicate improper bicep curl form by causing the weights to swing if too much momentum is used. In a different embodiment, the device is only comprised of rotating weights that can be used with existing barbell types, wherein said weights rotate/swing during use if improper form or inappropriate weight is used.

16 Claims, 4 Drawing Sheets

(56) References Cited

U.S. PATENT DOCUMENTS

| | | | | |
|---|---|---|---|---|
| 6,663,542 | B1 * | 12/2003 | Trabbic | A63B 21/0724 482/106 |
| 7,494,451 | B1 * | 2/2009 | Ramos | A63B 21/0728 482/148 |
| 8,574,136 | B1 * | 11/2013 | Burstrom | A63B 21/0724 482/109 |
| 9,155,930 | B2 * | 10/2015 | Adkins | A63B 21/0724 |
| 9,914,006 | B1 * | 3/2018 | Bell | A63B 21/0618 |
| 2008/0287271 | A1 * | 11/2008 | Jones | F16B 2/10 482/107 |
| 2016/0074694 | A1 * | 3/2016 | Huang | A63B 21/0728 482/106 |
| 2023/0173325 | A1 * | 6/2023 | Garcia | A63B 21/4049 482/106 |
| 2024/0033560 | A1 * | 2/2024 | Knuckles | A63B 21/4035 |
| 2024/0226640 | A1 * | 7/2024 | Deshpande | A63B 21/0726 |
| 2024/0261621 | A1 * | 8/2024 | Tolosa | A63B 21/0724 |

* cited by examiner

BICEP CURL DEVICE

CROSS-REFERENCE TO RELATED APPLICATION

The present application claims priority to, and the benefit of, U.S. Provisional Application No. 63/529,170, which was filed on Jul. 27, 2023, and is incorporated herein by reference in its entirety.

FIELD OF THE INVENTION

The present invention relates generally to the field of weightlifting. More specifically, the present invention relates to a bicep curl device comprised of a barbell with weights that swing if improper form or if too much weight is used when performing a bicep curl. In a different embodiment, the device is only comprised of a rotating weight that can be used with an existing barbell. Accordingly, the present disclosure makes specific reference thereto. Nonetheless, it is to be appreciated that aspects of the present invention are also equally applicable to other like applications, devices, and methods of manufacture.

BACKGROUND

Many individuals perform bicep curls as part of their workout routine. However, many individuals perform bicep curls incorrectly by inadvertently using larger muscle groups instead of isolating the biceps during the exercise. This incorrect form involves utilizing muscles such as the shoulders, back, or legs to aid in curling the weight, which can lead to ineffective training of the intended bicep muscles and increase the risk of injury. Often, without the presence of a coach or a knowledgeable observer to point out these mistakes, an individual may continue to perform bicep curls improperly without realizing it. This oversight can hinder progress and potentially lead to muscle imbalances and/or injury.

Therefore, there exists a long-felt need in the art for a bicep curl device that provides real-time feedback to the user. More specifically, there exists a long-felt need in the art of weightlifting for a weight bar device that can be used to perform a bicep curl that can provide real-time feedback to the user if they are using proper form, appropriate weight, and muscle groups to perform the exercise. Further, there exists a long-felt need in the art for an intelligent weight bar device or specially designed weights to be used on existing weight bars that can be used to perform a bicep curl wherein the device provides users feedback if a bicep curl is performed incorrectly while using the device.

The subject matter disclosed and claimed herein, in one embodiment thereof, comprises a bicep curl device. In one embodiment, the device is comprised of a bar with ends that can receive and/or may be comprised of a weight. The weight may have ball bearings that allow rotation of the weight to indicate improper bicep curl form or having an appropriate amount of weight by causing the weights to swing if too much momentum is used to perform the exercise by engaging other muscle groups. In a different embodiment, the device is only comprised of rotating weights that can be used with existing barbell types, wherein said weights rotate/swing during use if improper form is used.

In this manner, the bicep curl device of the present invention accomplishes all the forgoing objectives and provides a bicep curl device that provides real-time feedback to the user. More specifically, the device can provide real-time feedback to the user if they are using proper form and muscle groups to perform the exercise. Further, the device may be in the form of a weight bar or specially designed weights to be used on existing weight bars.

SUMMARY

The following presents a simplified summary to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a bicep curl device. In one embodiment, the device is comprised of a bar comprised of a first end and a second end. Each end may receive at least one weight in a fixedly or removably attached manner. More specifically, at least one opening (of any diameter) of the weight attaches to the bar, wherein the opening is comprised of at least one ball bearing that allows the weight to rotate 360 degrees around the perimeter of the bar. In a removable embodiment, the weight can be attached to an existing barbell type known in the art.

The weight may also be comprised of at least one member that preferably extends perpendicular from the side surface of the weight that allows a user to place a weight plate on the member. In a different embodiment, the weight is not comprised of a member 130 and can simply be placed on the end of a barbell in lieu of a traditional weight plate. This embodiment of the weight may or may not have ball bearings.

During use, the device can be used to perform bicep curls. Due to the ball bearing of each weight (in an embodiment with a bar), if improper form or inappropriate weight (i.e., just too much momentum) is used when performing a bicep curl the weights will begin to swing. This notifies a user that they are using improper form or using an inappropriate amount of weight to perform the bicep curl and that they should be using stricter form or less weight with less momentum. This same behavior occurs in an embodiment of the device comprised only of a weight with no member and no ball bearing that is placed on the end of a barbell in lieu of a traditional weight plate.

The present invention is also comprised of a first method of using the device. First, a device is provided comprised of a bar comprised of a first end comprised of a first weight, the first weight comprised of a member, a cover, and a first opening comprised of a first ball bearing; and a second end comprised of a second weight, the second weight comprised of a second, a second, and a second opening comprised of a second ball bearing. Then, a user can place a weight plate on the member. If a diameter of an opening of the weight plate is exceedingly larger than the diameter of the member, at least one cover can be placed over the member (wherein the cover is larger in diameter than the member) and secured via at least one mechanism. Next, a user can perform a bicep curl while gripping the bar. If the weights begin swinging during the bicep curl, a user can stop performing the bicep curl and restart the movement using stricter form or less weight with less momentum.

The present invention is also comprised of a second method of using the device. First, a device is provided comprised of weight comprised of an opening. Then, a user can place the weight onto the end of a barbell. Next, a user can perform a bicep curl while gripping the barbell. If the weights begin swinging during the bicep curl, a user can stop performing the bicep curl and restart the movement using stricter form or less weight with less momentum.

Accordingly, the bicep curl device of the present invention is particularly advantageous as it provides a bicep curl device that provides real-time feedback to the user. More specifically, the device can provide real-time feedback to the user if they are using proper form, appropriate weight, and muscle groups to perform the exercise. Further, the device may be in the form of a weight bar or specially designed weights to be used on existing weight bars. In this manner, the bicep curl device overcomes the limitations of existing devices and methods used for bicep curling known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
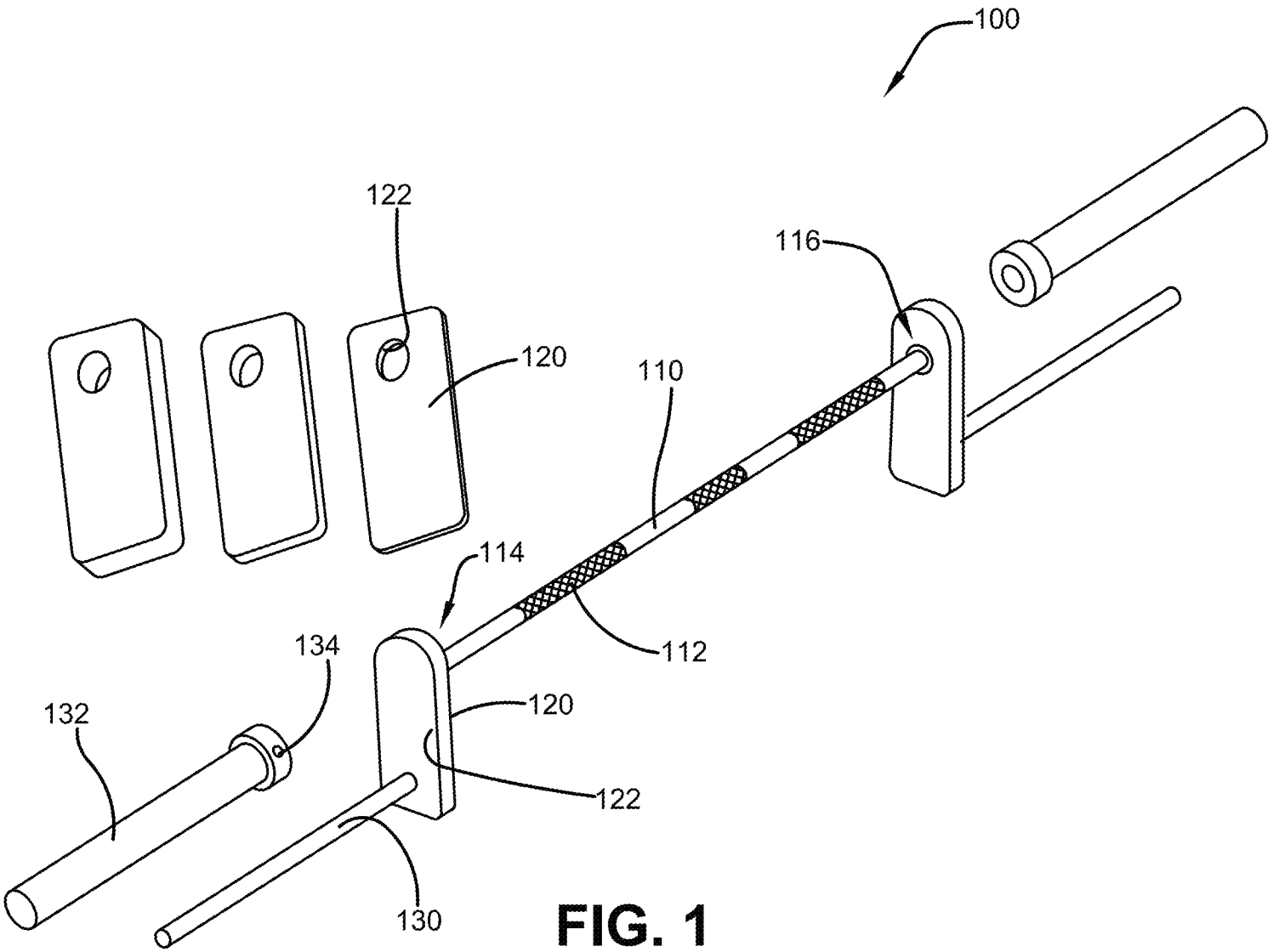
FIG. 1 illustrates a perspective view of two potential embodiments of a bicep curl device of the present invention in accordance with the disclosed architecture.

The innovation is now described with reference to the drawings, wherein like reference numerals are used to refer to like elements throughout. In the following description, for purposes of explanation, numerous specific details are set forth to provide a thorough understanding thereof. It may be evident, however, that the innovation can be practiced without these specific details. In other instances, well-known structures and devices are shown in block diagram form to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for a bicep curl device that provides real-time feedback to the user. More specifically, there exists a long-felt need in the art of weightlifting for a weight bar device that can be used to perform a bicep curl that can provide real-time feedback to the user if they are using proper form, appropriate amount of weight, and muscle groups to perform the exercise. Further, there exists a long-felt need in the art for an intelligent weight bar device or specially designed weights to be used on existing weight bars that can be used to perform a bicep curl wherein the device provides users feedback if a bicep curl is performed incorrectly while using the device.

The present invention, in one exemplary embodiment, is comprised of a bicep curl device. In one embodiment, the device is comprised of a bar with ends that can receive and/or may be comprised of a weight. The weight may have ball bearings that allow rotation of the weight to indicate improper bicep curl form by causing the weights to swing if too much momentum is used. In a different embodiment, the device is only comprised of rotating weights that can be used with existing barbell types, wherein said weights rotate/swing during use if improper form or too much weight is used.

Referring initially to the drawings, FIG. 1 illustrates a perspective view of two potential embodiments of a bicep curl device 100 of the present invention in accordance with the disclosed architecture. In one embodiment, the device 100 is comprised of a barbell bar 110. The bar 110 may be any length and diameter in different embodiments. The bar 110 may be made from any material such as but not limited to metal. The bar 110 may be comprised of at least one grip area 112. The grip area 112 may be comprised of a raised and/or recessed texture that improves grip on the bar 110, such as but not limited to knurling. The grip area 112 may be made from the same material as the bar 110 or may be made from a different material.

Figure 2:
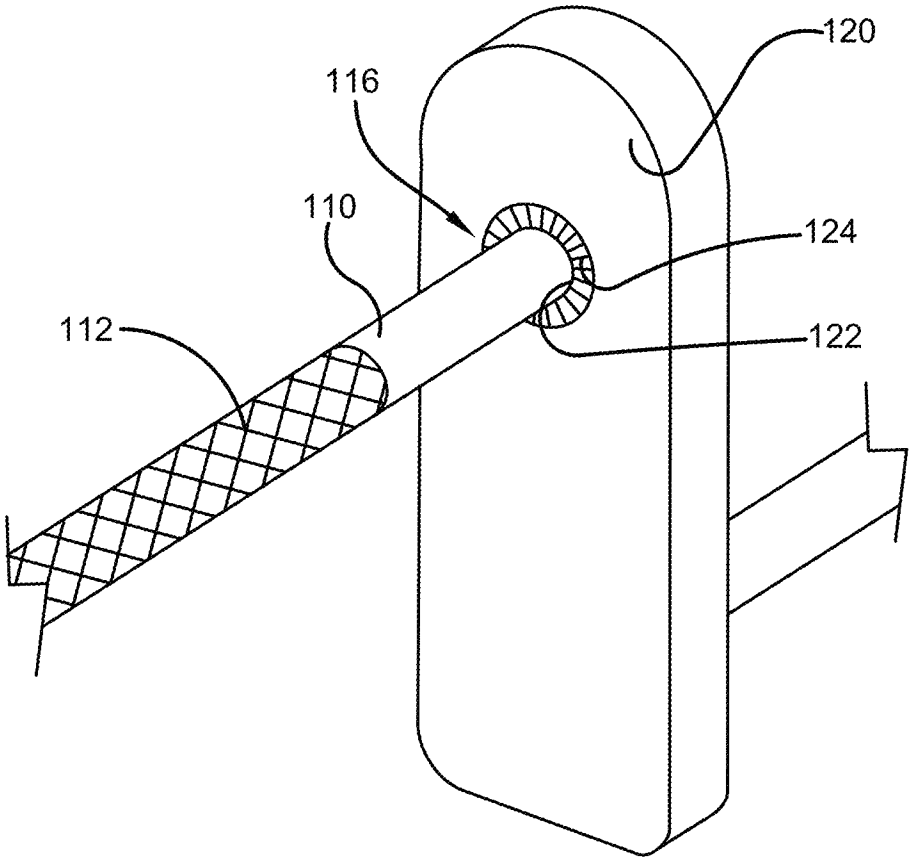
FIG. 2 illustrates an enhanced perspective view of one potential embodiments of a bicep curl device of the present invention with a barbell in accordance with the disclosed architecture.

The bar 110 is comprised of a first end 114 and a second end 116. The first end 114 may receive at least one weight 120 in a fixedly or removably attached manner. More specifically, at least one opening 122 (of any diameter) of the weight 120 attaches to the bar 110, wherein the opening 122 is comprised of at least one ball bearing 124, as seen in FIG. 2. The ball bearing 124 allows the weight 120 to rotate 360 degrees around the perimeter (i.e., the horizontal axis) of the bar 110. The weight 120 may weigh any weight increment in different embodiments. In a removable embodiment, the weight 120 can be attached to an existing barbell type known in the art.

The weight 120 may also be comprised of at least one member 130 that preferably extends perpendicular from the side surface 121 of the weight 120. The member 130 may be any diameter that allows a user to place a weight plate on the member 130. In one embodiment, the member 130 is comprised of a member 130 of a first diameter and a cover 130 for the member 130 of a second diameter. In this manner, the cover 132 can be placed over the member 130 if the diameter of an opening of a weight plate exceeds the diameter of the member 130. The cover 132 may be secured around the member 130 via at least one mechanism 134 such as but not limited to a set screw. In a different embodiment, the weight 120 is not comprised of a member 130 and can simply be placed on the end of a barbell in lieu of a traditional weight plate. This embodiment of the weight 120 may or may not have ball bearings.

During use, the device 100 can be used to perform bicep curls. Due to the ball bearing 124 of each weight 120 (in an embodiment with a bar 110), if improper form (i.e., just too much momentum) is used when performing a bicep curl the weights 120 will begin to swing. This notifies a user that they are using improper form to perform the bicep curl and that they should be using stricter form with less momentum.

This same behavior occurs in an embodiment of the device 100 comprised only of a weight 120 with no member 130 and no ball bearing 124 that is placed on the end of a barbell in lieu of a traditional weight plate.

Figure 3:
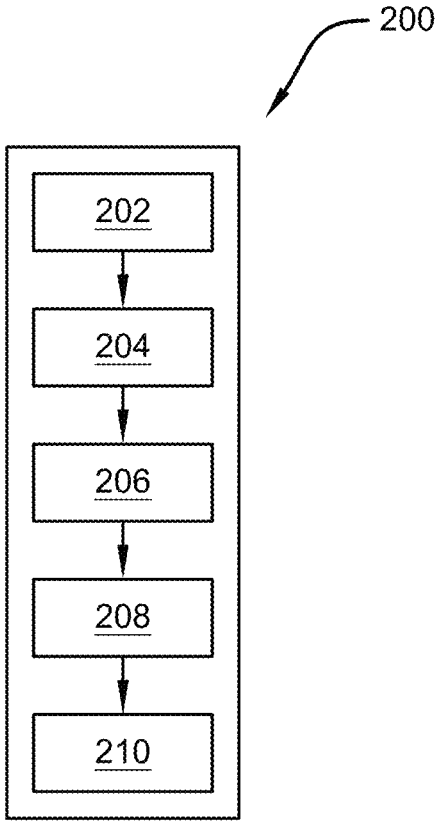
FIG. 3 illustrates a flowchart of a method of using one potential embodiment of a bicep curl device of the present invention in accordance with the disclosed architecture.

The present invention is also comprised of a first method of using 200 the device 100, as seen in FIG. 3. First, a device 100 is provided comprised of a bar 110 comprised of a first end 114 comprised of a first weight 120, the first weight 120 comprised of a member 130, a cover 132, and a first opening 122 comprised of a first ball bearing 124; and a second end 116 comprised of a second weight 120, the second weight 120 comprised of a second 130, a second 132, and a second opening 122 comprised of a second ball bearing 124 [Step 202]. Then, a user can place a weight plate on the member 130 [Step 204]. If a diameter of an opening of the weight plate is exceedingly larger than diameter of the member 130, at least one cover 132 can be placed over the member 130 (wherein the cover 132 is larger in diameter than the member 130) and secured via at least one mechanism 134 [Step 206]. Next, a user can perform a bicep curl while gripping the bar 110 [Step 208]. If the weights 120 begin swinging during the bicep curl, a user can stop performing the bicep curl and restart the movement using stricter form and/or appropriate amount of weight with less momentum [Step 210].

Figure 4:
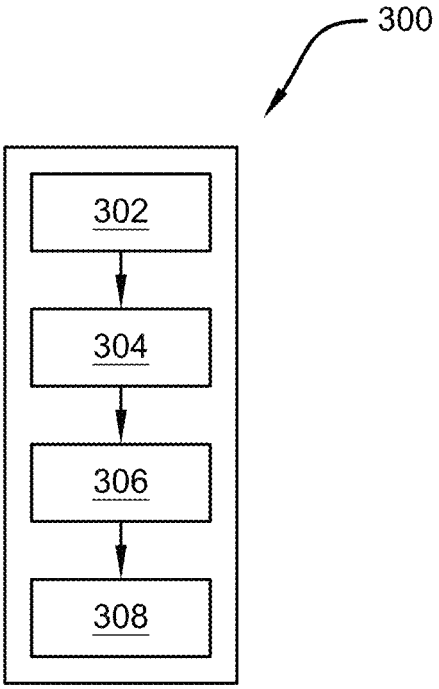
FIG. 4 illustrates a flowchart of a method of using one potential embodiment of a bicep curl device of the present invention in accordance with the disclosed architecture.

The present invention is also comprised of a second method of using 200 the device 100, as seen in FIG. 4. First, a device 100 is provided comprised of weight 120 comprised of an opening 122 [Step 302]. Then, a user can place the weight 120 onto the end of a barbell [Step 304]. Next, a user can perform a bicep curl while gripping the barbell [Step 306]. If the weights 120 begin swinging during the bicep curl, a user can stop performing the bicep curl and restart the movement using stricter form and/or using appropriate amount of weight with less momentum [Step 308].

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "bicep curl device" and "device" are interchangeable and refer to the bicep curl device 100 of the present invention.

Notwithstanding the forgoing, the bicep curl device 100 of the present invention and its various components can be of any suitable size and configuration as is known in the art without affecting the overall concept of the invention, provided that they accomplish the above-stated objectives. One of ordinary skill in the art will appreciate that the size, configuration, and material of the bicep curl device 100 as shown in the FIGS. are for illustrative purposes only, and that many other sizes and shapes of the bicep curl device 100 are well within the scope of the present disclosure. Although the dimensions of the bicep curl device 100 are important design parameters for user convenience, the bicep curl device 100 may be of any size, shape, and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A bicep curl device comprising:

a barbell comprised of a first end and a second end;

a plurality of first weights each attachable to the first end, wherein each of the first weights are comprised of a first opening comprised of a first ball bearing and a first member that extends outwards from each respective first weight;

a plurality of second weights each attachable to the second end, wherein each of the second weights are comprised of a second opening comprised of a second ball bearing and a second member that extends outwards from each respective second weight; and a pair of covers removably attachable to the first and second members respectively; and wherein each of the plurality of first and second weights have different masses.

2. The bicep curl device of claim 1, wherein the barbell is comprised of a grip area.

3. The bicep curl device of claim 2, wherein the grip area is comprised of a raised texture or a recessed texture.

4. The bicep curl device of claim 1, wherein each of the plurality of first weights are comprised of a rectangular shape.

5. The bicep curl device of claim 1, wherein each of the plurality of second weights are comprised of a rectangular shape.

6. The bicep curl device of claim 1, wherein each cover has a first diameter larger than a second diameter of a first member and a third diameter of a third member.

7. The bicep curl device of claim 1, wherein each cover is comprised of a set screw.

8. The bicep curl device of claim 1, wherein each of the plurality of first weights are can rotate 360 degrees around a horizontal axis of the bar.

9. The bicep curl device of claim 1, wherein each of the plurality of second weights are can rotate 360 degrees around a horizontal axis of the bar.

10. The bicep curl device of claim 7, wherein each cover removably attaches to a first member via the set screw.

11. The bicep curl device of claim 7, wherein each cover removably attaches to a second member via the set screw.

12. A method of using a bicep curl device, the method comprising the following steps:

providing a bicep curl device comprised of a barbell bar comprised of a first end comprised of a first weight comprised of a first member extending perpendicularly from a side of the first weight and a second end comprised of a second weight comprised of a second member extending perpendicularly from a side of the second weight;

putting a weight plate on the first member;

putting a second weight plate on the second member; and performing a bicep curl with the barbell bar such that the first weight and the second weight do not swing; and wherein the barbell bar further comprises a cover that removably attaches to the first member or the second member, the cover having a diameter configured to fit weight plate openings that are different than a diameter of the first member or second member.

13. The method of using a bicep curl device of claim 12, wherein the first weight is comprised of a first opening comprised of a first ball bearing.

14. The method of using a bicep curl device of claim 13, wherein the first weight is fixedly attached to the first end of the barbell bar.

15. The method of using a bicep curl device of claim 12, wherein the second weight is comprised of a second opening comprised of a second ball bearing.

16. The method of using a bicep curl device of claim 15, wherein the first weight is fixedly attached to the first end of the barbell bar.

* * * * *